US011576510B1

(12) United States Patent
Anderson et al.

(10) Patent No.: US 11,576,510 B1
(45) Date of Patent: Feb. 14, 2023

(54) SUBMERGIBLE UMBRELLA STAND

(71) Applicant: Ledge Lounger, Inc., Katy, TX (US)

(72) Inventors: Christopher Anderson, Fulshear, TX (US); David Bier, Conroe, TX (US)

(73) Assignee: Ledge Lounger, Inc., Katy, TX (US)

( * ) Notice: Subject to any disclaimer, the term of this patent is extended or adjusted under 35 U.S.C. 154(b) by 0 days.

(21) Appl. No.: 17/523,192

(22) Filed: Nov. 10, 2021

(51) Int. Cl.
*A47G 25/12* (2006.01)
*B63B 22/20* (2006.01)
*E04H 12/22* (2006.01)

(52) U.S. Cl.
CPC ..... *A47G 25/12* (2013.01); *B63B 22/20* (2013.01); *E04H 12/2246* (2013.01); *Y10S 248/91* (2013.01)

(58) Field of Classification Search
CPC .... A47G 25/12; B63B 22/20; E04H 12/2246; E04H 4/14; Y10S 248/91
USPC ..... 211/62; 248/500, 519, 910, 346.2; 4/496; 135/95; D3/10
See application file for complete search history.

(56) References Cited

U.S. PATENT DOCUMENTS 503,708 A * 8/1893 Ross ..... A47G 25/12 D11/118
1,189,024 A * 6/1916 White ..... A61J 19/06 248/346.04
1,270,004 A * 6/1918 Chappell ..... A47F 7/08 248/910
1,631,227 A * 6/1927 See ..... E04H 12/2246 292/76
RE17,500 E * 11/1929 Stevenson et al. . A24F 19/0071 248/910
1,735,671 A * 11/1929 Bunker ..... A24F 19/0071 248/910
1,986,140 A * 1/1935 Dapp ..... F16M 5/00 248/910
2,514,109 A * 7/1950 Walsh ..... A47B 91/08 248/910
2,784,577 A * 3/1957 Beaham ..... A47G 23/0216 215/393
3,119,588 A * 1/1964 Keats ..... E01F 9/688 40/607.04
3,499,413 A * 3/1970 Heard ..... E01F 9/688 116/63 P
3,648,659 A * 3/1972 Jones ..... A01K 39/02 219/521
3,661,270 A * 5/1972 Lucci ..... A47G 25/00 211/205
4,148,455 A * 4/1979 Oliver ..... E04H 12/2246 248/524

(Continued)

*Primary Examiner* — Jennifer E. Novosad
(74) *Attorney, Agent, or Firm* — Banner & Witcoff, Ltd.

(57) ABSTRACT

A submergible umbrella stand includes a body including a top, a bottom spaced from the top, and a body wall extending between the top and the bottom and defining a body cavity therein. At least one filling aperture is formed in the top. An umbrella sleeve is positioned within the body and is configured to receive an umbrella pole. An upper recess is formed in the top and includes an upper recess sidewall extending inwardly and downwardly from the top of the body into the body cavity and a bottom extending inwardly from a bottom of the upper recess sidewall. A first sleeve aperture is formed in the bottom of the upper recess, with the umbrella sleeve extending through the first sleeve aperture.

19 Claims, 9 Drawing Sheets

(56) References Cited

U.S. PATENT DOCUMENTS 4,232,846 A * 11/1980 Bressani ..... E04H 12/2238 248/910
4,286,409 A * 9/1981 Taylor ..... A47G 33/12 248/527
4,296,693 A * 10/1981 Archer ..... E04H 12/2246 248/910
4,359,786 A * 11/1982 Rosberg ..... A61G 9/006 4/144.1
4,591,126 A * 5/1986 Berney ..... F16M 11/22 248/524
5,020,764 A * 6/1991 Yamamoto ..... E04H 12/2246 248/910
5,088,680 A * 2/1992 Farmer ..... E01F 9/692 248/910
5,169,111 A * 12/1992 Dunaj ..... A45B 25/24 248/528
5,207,406 A * 5/1993 Stine ..... E04H 12/2269 248/346.06
5,299,588 A * 4/1994 MacLeod ..... B63B 34/565 441/130
5,354,031 A * 10/1994 Bilotti ..... E04H 12/2238 248/910
5,465,677 A * 11/1995 Alter ..... B63B 21/50 114/230.1
5,517,702 A * 5/1996 Fraher ..... E04H 4/108 248/161
5,639,055 A * 6/1997 Fritz ..... A61H 3/0244 248/176.1
6,139,382 A * 10/2000 Eschbacher ..... B63B 22/24 441/32
6,199,818 B1 * 3/2001 Tsappi ..... A01G 9/124 248/524
6,209,147 B1 * 4/2001 Wheaton ..... E04H 4/14 4/496
6,299,124 B1 * 10/2001 Reback ..... F16M 11/046 248/527
6,554,012 B2 * 4/2003 Patarra ..... A45B 3/00 62/331
6,726,208 B2 * 4/2004 Wilkus ..... F41J 1/10 248/523
6,869,058 B2 * 3/2005 Tung ..... E04H 12/2238 248/910
6,895,982 B1 * 5/2005 Shaw ..... E04H 12/2246 135/16
6,938,870 B1 * 9/2005 Salvador ..... A47B 23/007 248/910
6,986,496 B2 * 1/2006 Roberts ..... E01F 9/692 40/607.01
8,047,217 B1 * 11/2011 Schermerhorn, Jr. ..... E04H 12/2215 248/910
9,463,850 B2 * 10/2016 Lovett ..... B29D 35/122
9,648,930 B1 * 5/2017 Mejia ..... E04H 12/22
10,327,418 B2 * 6/2019 Johnson ..... A01K 7/00
2005/0023428 A1 * 2/2005 Woude ..... E04H 12/2246 248/530
2007/0236060 A1 * 10/2007 Switzer ..... A47C 15/006 297/240
2011/0000132 A1 * 1/2011 Kamau ..... A01G 9/02 47/66.7
2012/0124733 A1 * 5/2012 Roberts ..... E04H 4/14 4/496
2015/0225041 A1 * 8/2015 Lovett ..... A45B 25/00 441/32
2021/0145169 A1 * 5/2021 Schwiebert ..... E04H 4/14
2022/0104614 A1 * 4/2022 Schneiderman ..... A45B 23/00
2022/0268049 A1 * 8/2022 Frerich ..... A45B 23/00

* cited by examiner

SUBMERGIBLE UMBRELLA STAND

FIELD

Aspects of this invention relate generally to a submergible umbrella stand, and, in particular, to a submergible umbrella stand having a wall cavity configured to be filled with water and sealed to ensure the water level inside the unit doesn't equalize with the water outside the unit.

BACKGROUND

Individuals may often float, swim, and stand in a swimming pool in order to cool off and socialize with others. The individuals may rest on inflatable devices that float in the pool. The individuals may also place stools, chairs, or other objects in the pool in order to provide seating and surfaces upon which to rest food and drinks.

It would be desirable to provide a submergible umbrella stand that can provide shade for individuals in a swimming pool, and to provide a surface upon which to rest food and drinks. Particular objects and advantages will be apparent to those skilled in the art, that is, those who are knowledgeable or experienced in this field of technology, in view of the following disclosure of the invention and detailed description of certain embodiments.

SUMMARY

Aspects of the present invention may be used to advantageously provide a submergible umbrella stand that can avoid being tipped over, and can provide a reservoir for storing ice.

In accordance with a first aspect, a submergible umbrella stand includes a body including a top, a bottom spaced from the top, and a body wall extending between the top and the bottom and defining a body cavity therein. At least one filling aperture is formed in the top. An umbrella sleeve is positioned within the body and is configured to receive an umbrella pole. An upper recess is formed in the top and includes an upper recess sidewall extending inwardly and downwardly from the top of the body into the body cavity and a bottom extending inwardly from a bottom of the upper recess sidewall. A first sleeve aperture is formed in the bottom of the upper recess, with the umbrella sleeve extending through the first sleeve aperture In accordance with another aspect, a submergible umbrella stand includes a body including a top, a bottom spaced from the top, and a body wall extending between the top and the bottom and defining a body cavity therein. A pair of filling apertures is formed in the top. A pair of drain apertures is formed in the bottom. An upper recess is formed in the top of the body and includes an upper recess sidewall extending inwardly and downwardly from the top of the body into the body cavity and a bottom extending inwardly from a bottom of the upper recess sidewall, with a first sleeve aperture being formed in the bottom of the upper recess. A lower recess is formed in the bottom of the body and includes a lower recess sidewall extending inwardly and upwardly from the bottom of the body into the body cavity and a top extending inwardly from a top of the lower recess sidewall, with a second sleeve aperture being formed in the top of the lower recess. An umbrella sleeve extends vertically within the body through the first sleeve aperture and the second sleeve aperture.

From the foregoing disclosure, it will be readily apparent to those skilled in the art, that is, those who are knowledgeable or experienced in this area of technology, that preferred embodiments of a submergible umbrella stand may provide a significant technological advance that allows the submergible umbrella stand to resist wind without tipping over, and provide a reservoir for ice. These and additional features and advantages will be further understood from the following detailed disclosure of certain preferred embodiments.

Figure 1:
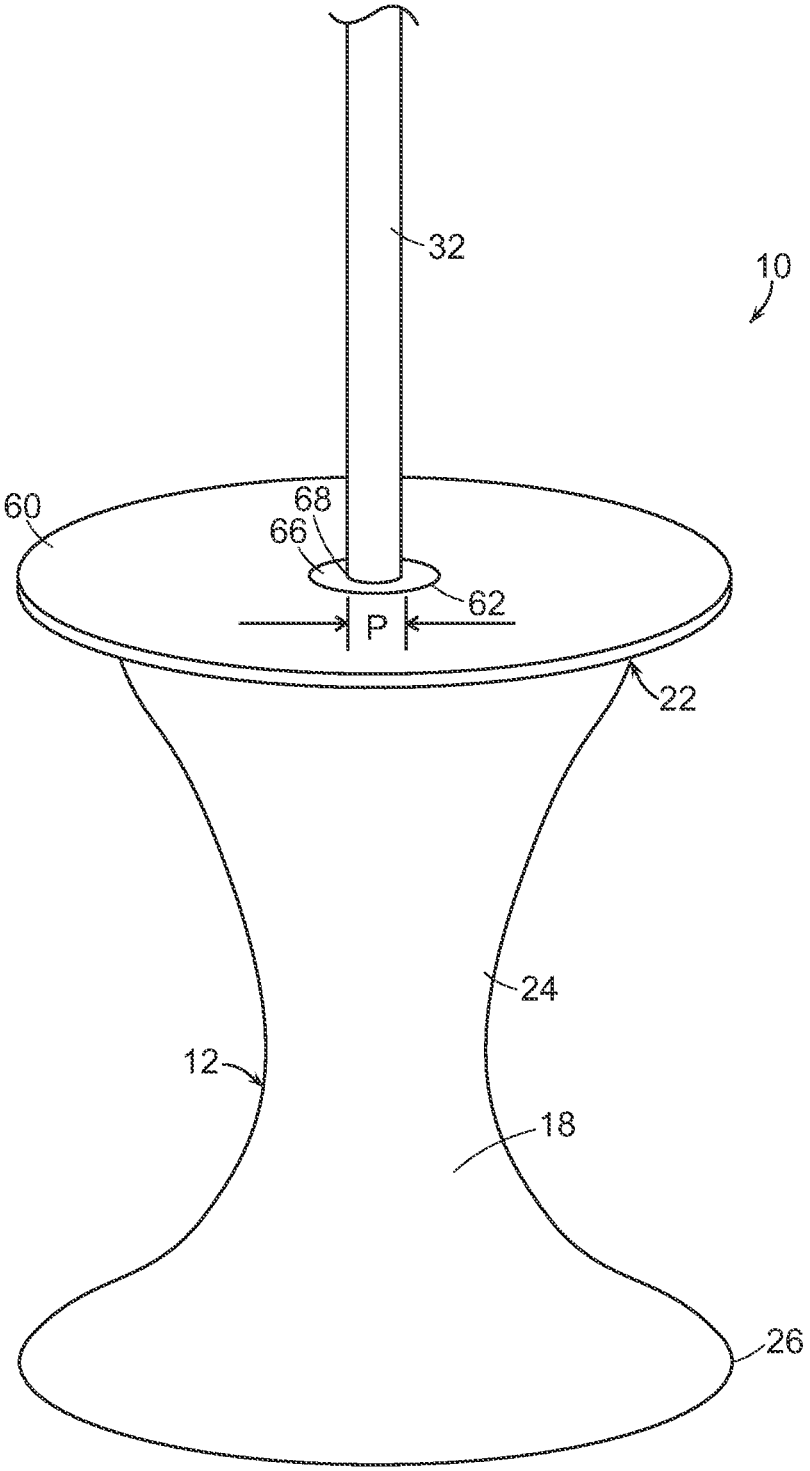
FIG. 1 is a perspective view of a submergible umbrella stand according to aspects of the disclosure, shown with an umbrella pole.

The figures referred to above are not drawn necessarily to scale and should be understood to provide a representation of umbrella stand, illustrative of the principles involved. Some features of the submergible umbrella stand depicted in the drawings have been enlarged or distorted relative to others to facilitate explanation and understanding. The same reference numbers are used in the drawings for similar or identical components and features shown in various alternative embodiments. Submergible umbrella stands as disclosed herein would have configurations and components determined, in part, by the intended application and environment in which they are used.

DETAILED DESCRIPTION OF CERTAIN PREFERRED EMBODIMENTS

Figure 2:
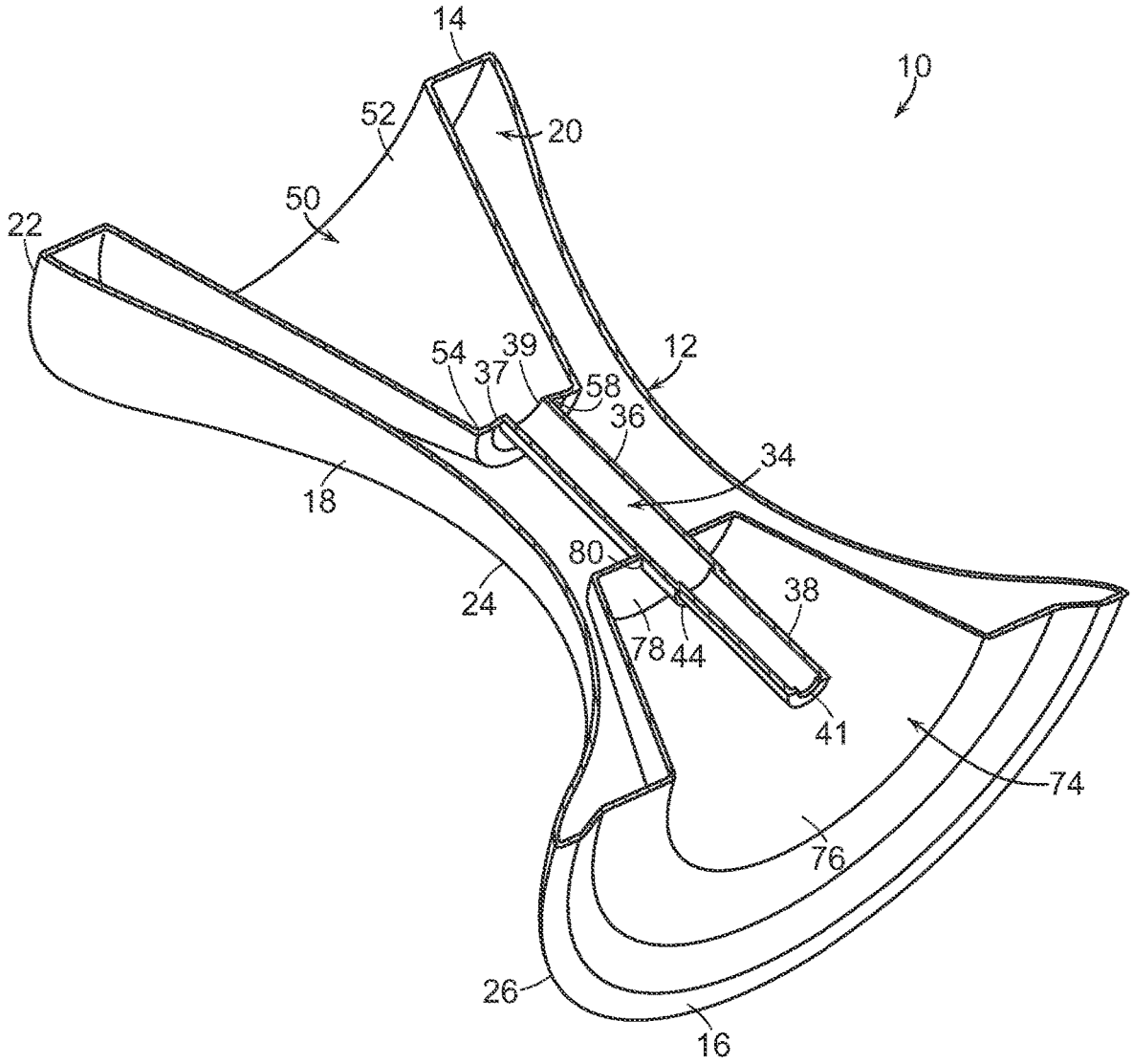
FIG. 2 is a perspective view, in section, of the submergible umbrella stand of FIG. 1.
Figure 3:
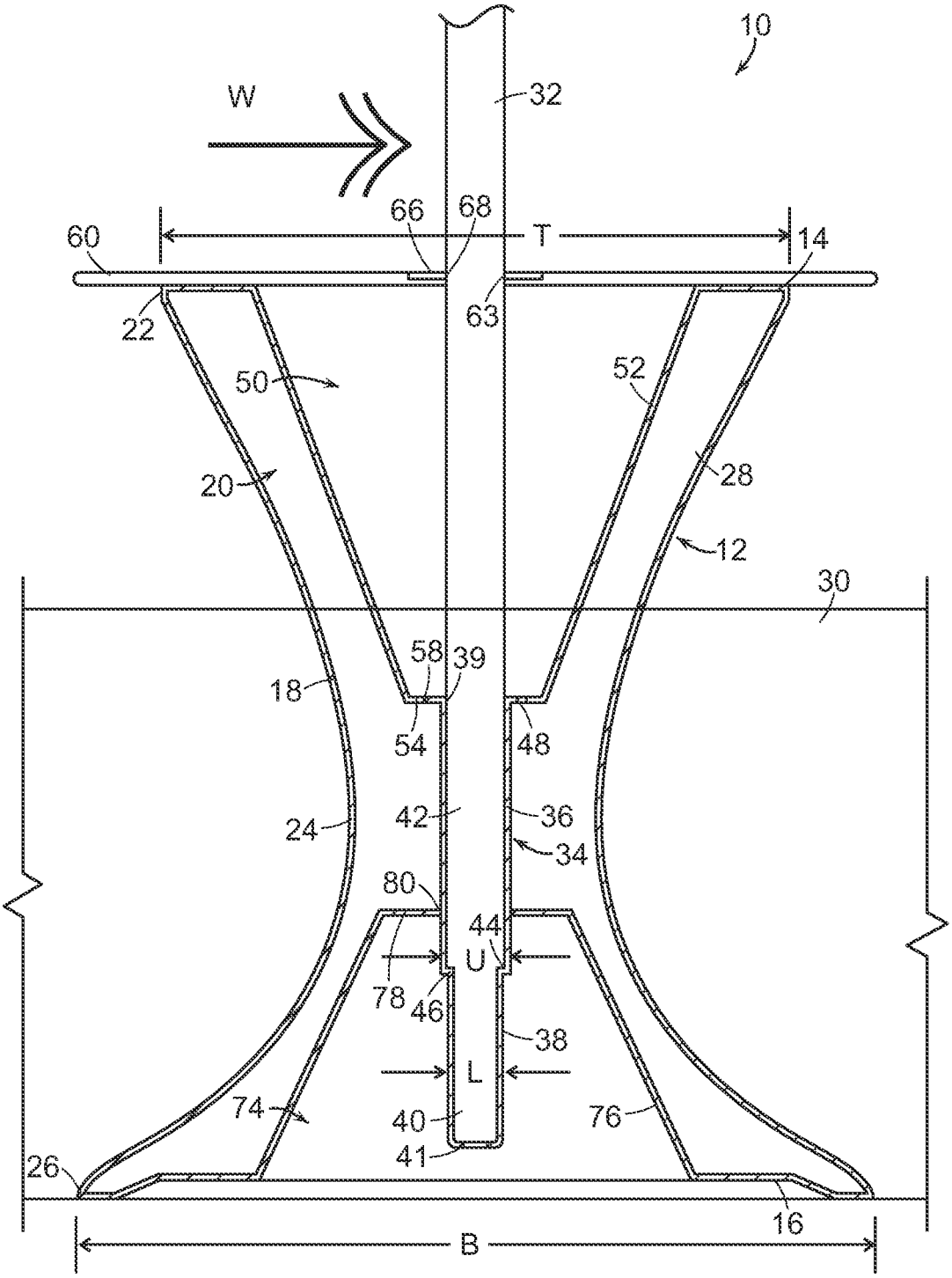
FIG. 3 is a section view of the submergible umbrella stand and umbrella pole of FIG. 1.

The present invention may be embodied in various forms. An embodiment of a submergible umbrella stand 10 is shown in FIGS. 1-3. For convenience, terms such as upper, lower, top, bottom, front, and rear may be used herein to differentiate between the upper and lower ends and front and rear sides of submergible umbrella stand 10 and particular components of submergible umbrella stand 10. It is to be appreciated that such terms are used only for ease of description and understanding and that they are not intended to limit the possible spatial orientations of the submergible umbrella stand or its components during assembly or use.

The term "substantially", as used herein, is meant to mean mostly, or almost the same as, within the constraints of sensible commercial engineering objectives, costs, manufacturing tolerances, and capabilities in the field of submergible umbrella stand manufacturing and use. Similarly, the term "approximately" as used herein is meant to mean close to, or about a particular value, within the constraints of sensible commercial engineering objectives, costs, manufacturing tolerances, and capabilities in the field of submergible umbrella stand manufacturing and use.

Submergible umbrella stand 10 may include a body 12 including a top 14, a bottom 16 spaced from top 14, and a body wall 18 extending between top 14 and bottom 16. Body wall 18, top 14, and bottom 16 may define a body cavity 20 contained therein.

In certain embodiments, body 12 may have an hourglass shape with body wall 18 tapering inwardly from a top edge 22 thereof toward a central portion 24 of body 12, and tapering outwardly from central portion 24 toward a bottom edge 26 thereof.

Body 12 may have a top diameter T at top edge 22 of body wall 18 and a bottom diameter B at bottom edge 26 of body wall 18. In certain embodiments, bottom diameter B is larger than top diameter T. It is to be appreciated that in other embodiments top diameter T could be larger than bottom diameter B, and in other embodiments top diameter T and bottom diameter B could have the same value.

Bottom diameter B may be between approximately 22 inches and approximately 33 inches, and, more particularly, approximately 28 inches. Top diameter D may be between approximately 4 inches and approximately 28 inches.

Body cavity 20 may contain liquid 28, e.g., water, which may provide stability for submergible umbrella stand 10 when it is seated in water 30, as seen in FIG. 3, such as when submergible umbrella stand 10 is seated in a swimming pool. In certain embodiments, the maximum depth of water 30 in the pool is approximately 18 inches. Body cavity 20 may be partially or completely filled with water when submergible umbrella stand 10 is seated in a swimming pool.

An umbrella pole 32 supporting an umbrella (not shown) may be received in submergible umbrella stand 10. As seen most clearly in FIG. 3, water 28 in body cavity 20 may help prevent submergible umbrella stand 10 from tipping when the umbrella is subjected to high winds, as illustrated by arrow W. Water contained within body 12 ensures that it is very difficult to tip over submergible umbrella stand 10.

Such a configuration allows the umbrella on umbrella pole 32 to be secured in a stable stand, while submerged in water up to approximately 18 inches deep, without needing to provide an umbrella receiver in the floor or base of the pool. An umbrella sleeve 34 configured to receive umbrella pole 32 may be positioned and extend vertically within body 12 of submergible umbrella stand 10. As seen in FIGS. 2-3, umbrella sleeve 34 may include an upper portion 36 and a lower portion 38. A flange 37 may extend laterally outwardly about an upper edge of upper portion 36 of umbrella sleeve 34.

Lower portion 38 may be configured to receive a lowermost end portion 40 of umbrella pole 32, while upper portion 36 may be configured to receive a central portion 42 of umbrella pole 32. An upper aperture 39 may be formed at an upper end of upper portion 36, and a lower aperture 41 may be formed at a lower end of lower portion 38. Umbrella pole 32 may be inserted into umbrella sleeve 34 through upper aperture 39.

Upper portion 36 may be substantially cylindrical with a diameter U. In certain embodiments, upper portion 36 is tapered so as to easily receive an umbrella pole 32 having a diameter of approximately 2 inches. In such an embodiment, diameter U may be approximately 2.2 inches at a top end thereof, and taper to a diameter of approximately 1.8 inches at a lower end thereof. Such a tapered configuration for upper portion 36 may allow for an umbrella pole 32 having a diameter of approximately 2 inches to be become wedged and centered within upper portion 36.

A sleeve shoulder 44 may extend laterally between a lower edge of upper portion 36 and an upper edge of lower portion 38 of umbrella sleeve 34.

Lower portion 38 may be cylindrical with a diameter L. In certain embodiments, lower portion 38 is tapered so as to easily receive an umbrella pole 32 having a diameter of approximately 1.5 inches. In such an embodiment, diameter L may be approximately 1.7 inches at a top end thereof, and taper to a diameter of approximately 1.3 inches at a lower end thereof. Such a tapered configuration for lower portion 38 may allow for an umbrella pole 32 having a diameter of approximately 1.5 inches to be become wedged and centered within lower portion 38.

In certain embodiments, an upper recess 50 may be formed in top 14 of body 12. Upper recess 50 may have an upper recess sidewall 52 and a bottom 54. Upper recess sidewall 52 may taper inwardly from top 14 to bottom 54, and bottom 54 may extend radially inwardly from a bottom of upper recess sidewall 52. A first sleeve aperture 58 may be formed in bottom 54, and umbrella sleeve 34 may extend through first sleeve aperture 58. In certain embodiments, a peripheral edge of flange 37 may be secured to first sleeve aperture 58.

In certain embodiments, upper recess 50 may form a reservoir that can be filled with ice to keep beverages and other items cold for users in the swimming pool. When the ice in upper recess 50 melts, the resulting water may pass into umbrella sleeve 34 through upper aperture 39 and out of umbrella sleeve 34 through lower aperture 41.

Figure 4:
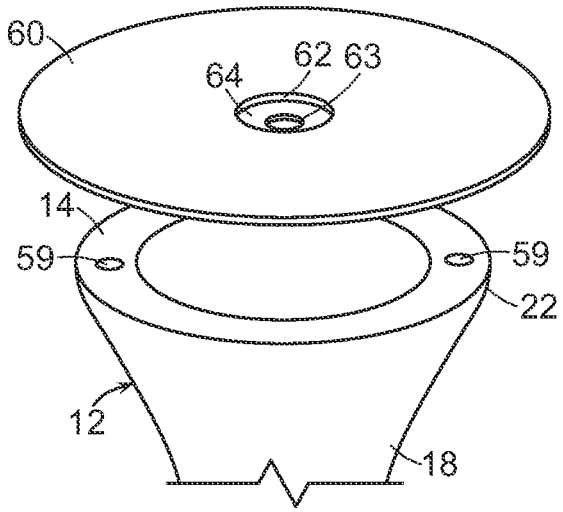
FIG. 4 is a perspective view, shown partially broken away, of a portion of the submergible umbrella stand of FIG. 1, and a cover.

As seen in FIG. 4, at least one filling aperture 59 may be formed in top 14. Water may be introduced into body cavity 20 through each filling aperture 59. In the illustrated embodiment, two filling apertures 29 are formed in top 14. It is to be appreciated that any number of filling apertures 59 may be formed in top 14.

In certain embodiments, a top cover 60 may rest on top 14 of body 12, covering filling apertures 59. Top cover 60 may include a central recess 62 and a central aperture 63 formed in a bottom 64 of central recess 62. Central aperture 63 may receive umbrella pole 32.

As seen in FIG. 1, a first insert 66 may be seated within central recess 62, and first insert 66 may include a first pole aperture 68 configured to receive umbrella pole 32. First pole aperture 68 may have a diameter P. In certain embodiments, diameter P may be approximately 2.05 inches so as to easily receive umbrella pole 32 having a diameter of approximately 2 inches.

Figure 5:
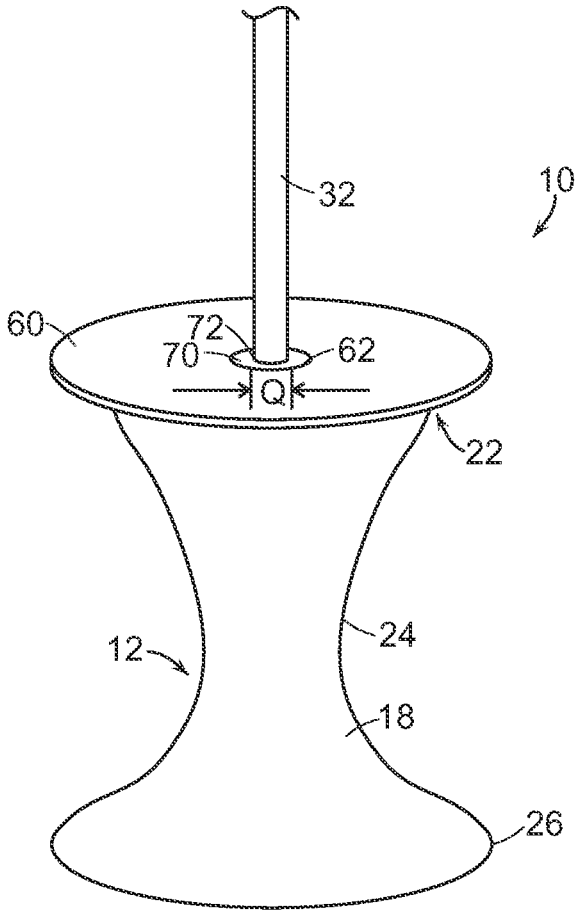
FIG. 5 is a perspective view of an alternative embodiment of the submergible umbrella stand of FIG. 1.

In other embodiments, as illustrated in FIG. 5, a second insert 70 may have a second pole aperture 72, and may be configured to receive umbrella pole 32. Second pole aperture 72 may have a diameter Q. In certain embodiments, diameter Q may be approximately 1.55 inches so as to easily receive umbrella pole 32 having a diameter of approximately 1.5 inches.

In certain embodiments, top cover 60, first insert 66, and second insert 70 each may be formed of a resin, a plastic, or an elastomer. For example, top cover 60, first insert 66, and second insert 70 may be formed of high density polyethylene (HDPE). Other suitable materials for top cover 60, first insert 66, and second insert 70 will become readily apparent to those skilled in the art, given the benefit of this disclosure.

Figure 6:
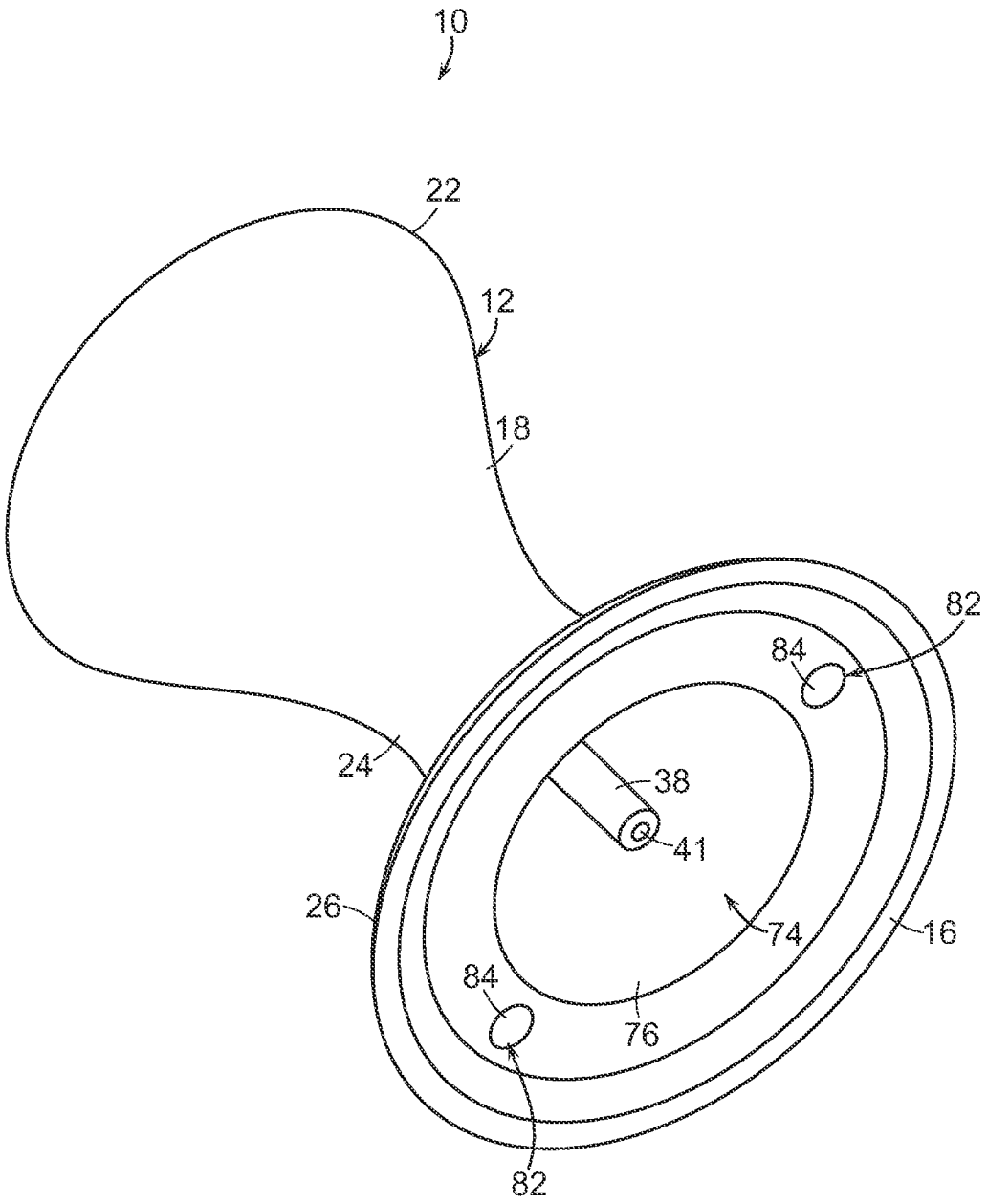
FIG. 6 is a bottom perspective view of the submergible umbrella stand of FIG. 1.

In certain embodiments, as seen in FIGS. 2, 3, and 6, a lower recess 74 may be formed in bottom 16 of body 12. Lower recess 74 may have a lower recess sidewall 76 and a top 78. Lower recess sidewall 76 may taper inwardly from bottom 16 to top 78, and top 78 may extend radially inwardly from a top of lower recess sidewall 76. A second sleeve aperture 80 may be formed in top 78, and umbrella sleeve 34 may extend through second sleeve aperture 80. In such an embodiment, a lower end of upper portion 36, and lower portion 38 of umbrella sleeve each may extend downwardly into and be received in lower recess 74.

Lower recess 74 may serve to reduce the amount of water captured within body cavity 20 so as to reduce the weight of submergible umbrella stand 10, while still providing sufficient stability for submergible umbrella stand 10, helping prevent it from tipping over when wind W engages the umbrella in depths of water up to approximately 18 inches.

In certain embodiments, each of body 12 and umbrella sleeve 34 may be formed individually as molded parts, and then co-molded together. Thus, flange 37 of umbrella sleeve 34 may be secured to first sleeve aperture 58 in bottom 54 of upper recess 50 by co-molding, and a peripheral edge of upper portion 36 of umbrella sleeve 34 may be secured to second sleeve aperture 80 in top 78 of lower recess 74 by co-molding.

In certain embodiments, body 12 and umbrella sleeve 34 may be formed of a resin, a plastic, or an elastomer. For example, body 12 and umbrella sleeve 34 may be formed of low density polyethylene (LDPE). Other suitable materials for body 12 and umbrella sleeve 34 will become readily apparent to those skilled in the art, given the benefit of this disclosure.

In certain embodiments, as illustrated in FIG. 6, one or more drain apertures 82 may be formed in bottom 16, and may serve to help drain water from body cavity 20. A drain cap 84 may be removably secured within each drain aperture 82, which may serve to prevent the water from inadvertently draining from body cavity 20. In the illustrated embodiment, two drain apertures 82 are formed in bottom 16, with drain caps 84 secured thereto. It is to be appreciated that any number of drain apertures 82 may be formed in bottom 16.

Figure 7:
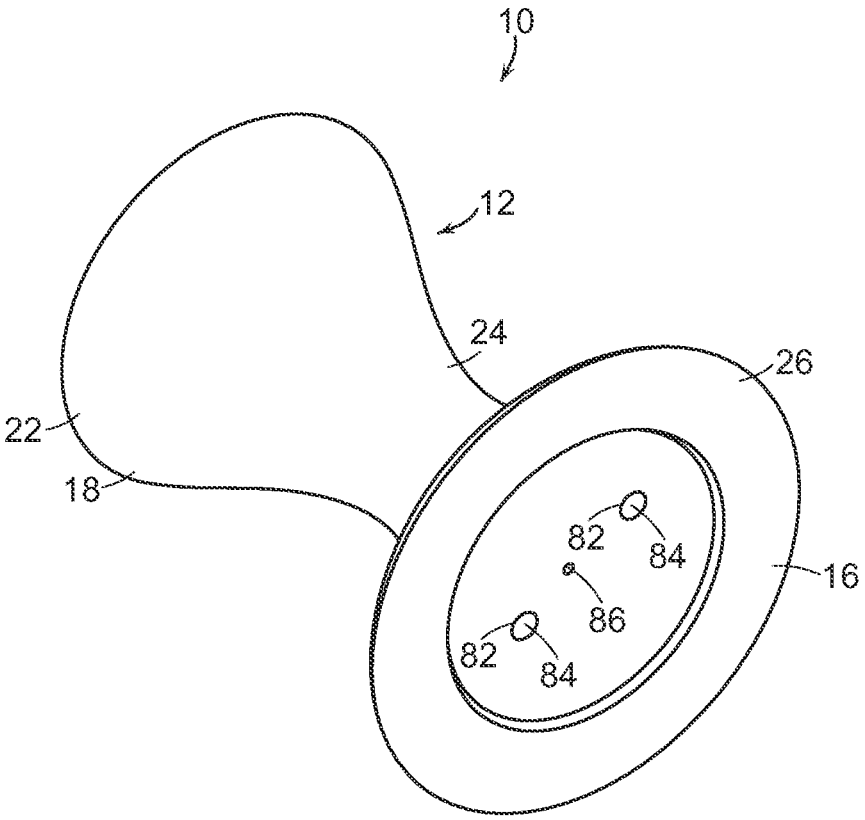
FIG. 7 is a bottom perspective view of an alternative embodiment of the submergible umbrella stand of FIG. 1.

In certain embodiments, as illustrated in FIG. 7, bottom 16 may be formed without lower recess 74 as seen in FIG. 2. In such an embodiment, a central drain aperture 86 may be formed in a central portion of bottom 16. Central drain aperture 86 may allow the water from melted ice that has passed through umbrella sleeve 34 to exit body 12 of submergible umbrella stand 10.

Figure 8:
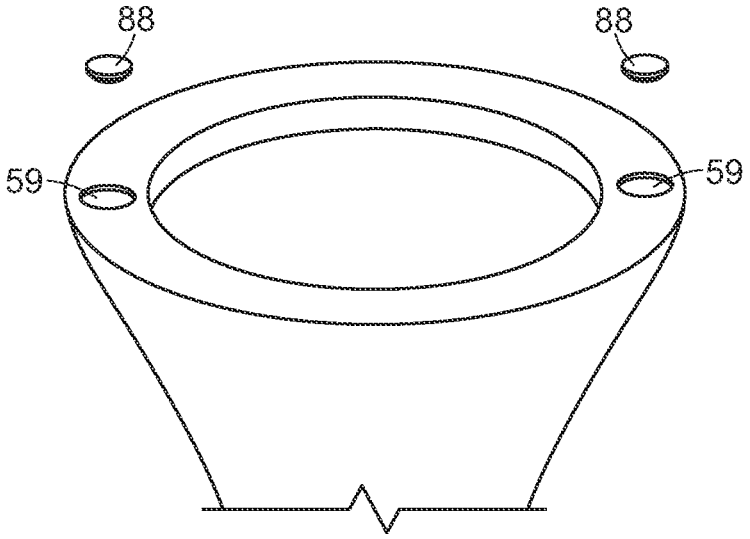
FIG. 8 is perspective view, shown partially broken away, of an alternative embodiment of the top of the submergible umbrella stand of FIG. 1.

In certain embodiments, as illustrated in FIG. 8, plugs 88 may be removably seated in filling apertures 59. Plugs 88 may fit within filling apertures 59 in snap-fit fashion.

Figure 9:
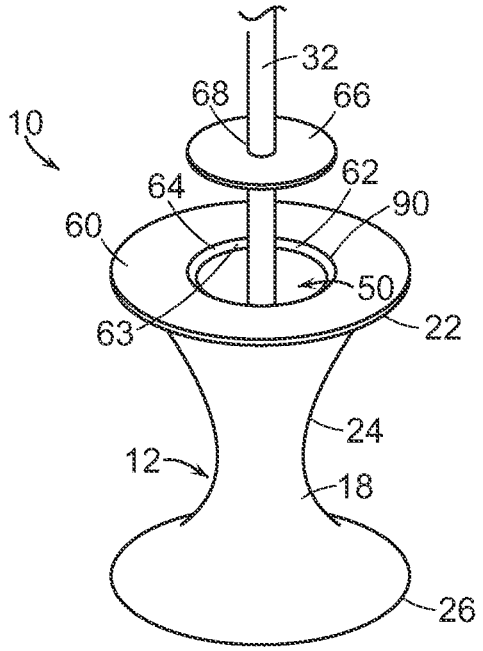
FIG. 9 is a perspective view of the submergible umbrella stand of FIG. 1, shown with a first insert raised to provide access the reservoir.
Figure 10:
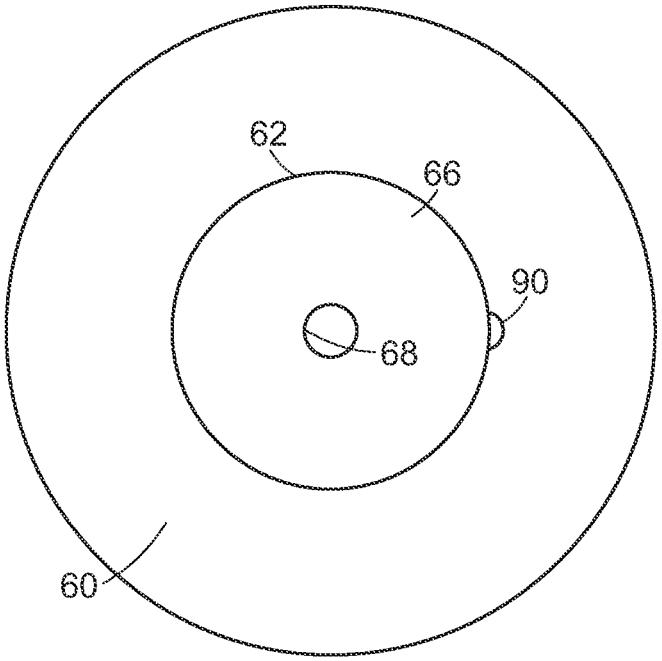
FIG. 10 is a plan view of the top cover of the submergible umbrella stand of FIG. 1.

In certain embodiments, as illustrated in FIGS. 9-10, first insert 66 (or second insert 70) may be lifted upwardly out of central recess 62, allowing the user to access reservoir 50 and retrieve beverages or other items sitting on ice in reservoir 50. A notch 90 may be formed in the periphery of central recess 62, allowing the user to insert a finger beneath the peripheral edge of first insert 66 in order to lift it out of central recess 62.

Figure 11:
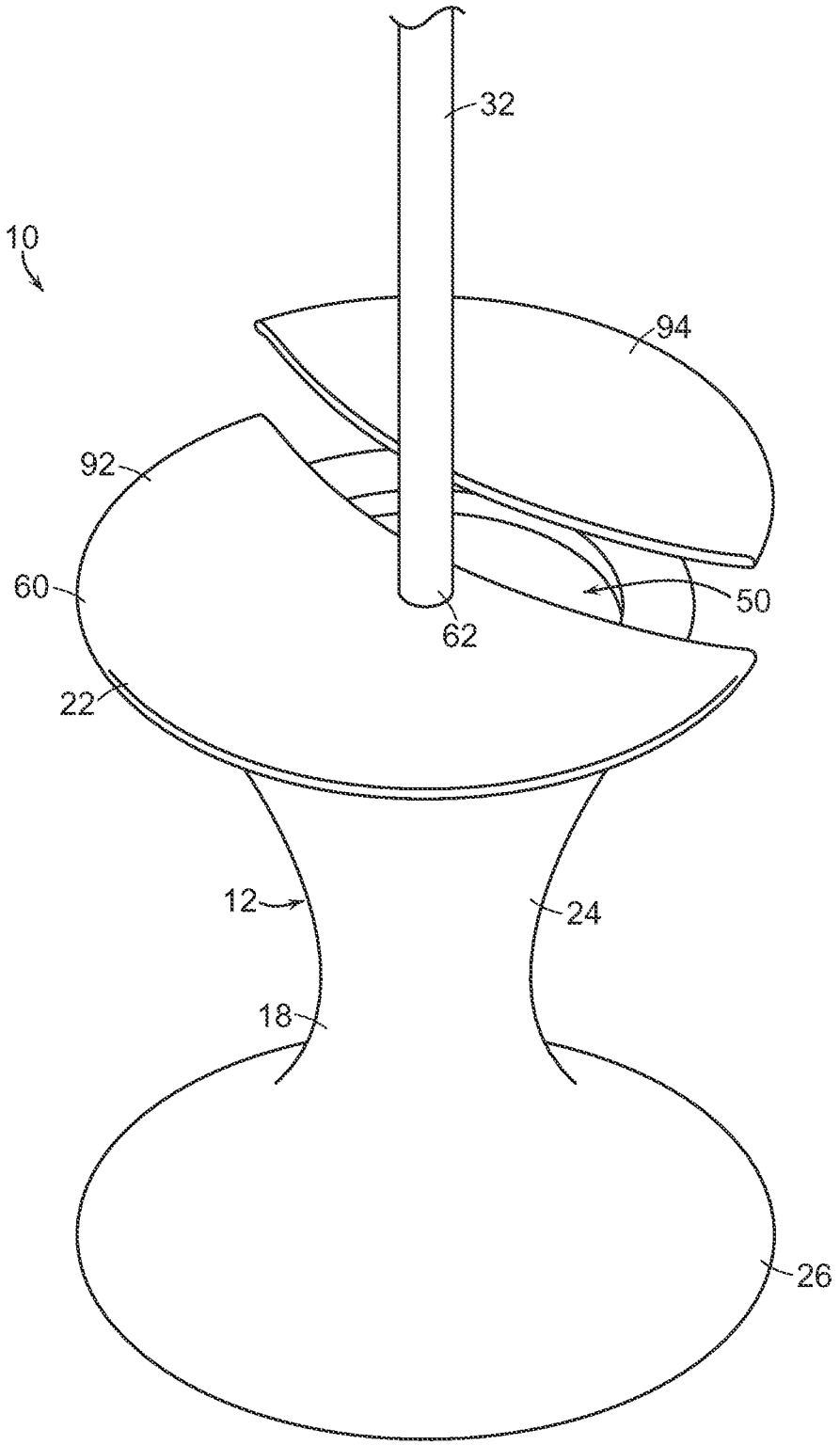
FIG. 11 is perspective view of an alternative embodiment of the submergible umbrella stand of FIG. 1, shown with a top cover formed of two portions.

In certain embodiments, as illustrated in FIG. 11, top cover 60 may not include an insert, and umbrella pole 32 may be received directly in central recess 62. In such an embodiment, top cover 60 may be formed of a first portion 92 and a second portion 94. First portion 92 may be larger than second portion 94, and central recess 62 may be formed in first portion 92. To access reservoir 50 and its contents, the user may lift second portion 94 upwardly away from body 12.

Figure 12:
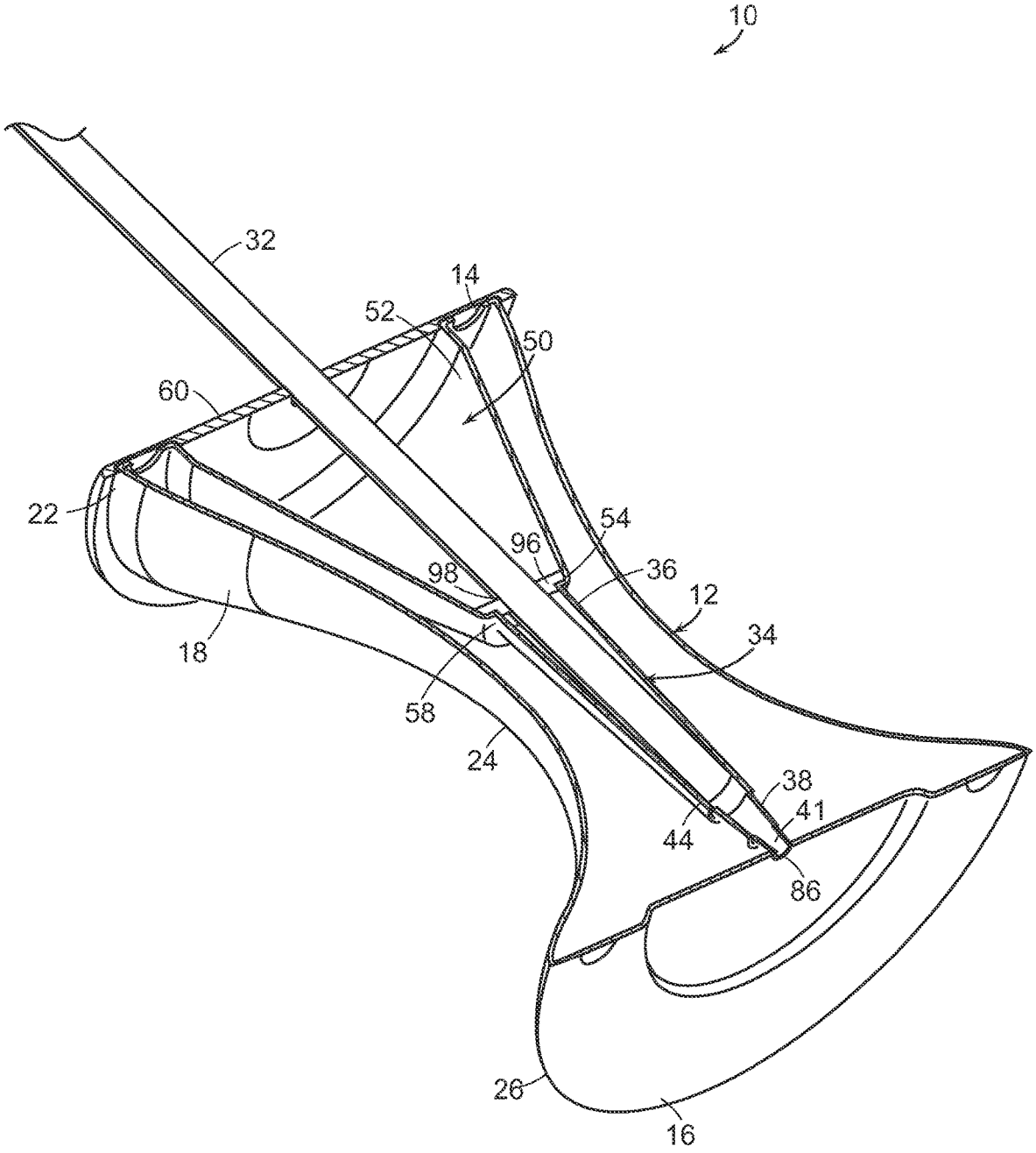
FIG. 12 is a perspective view, in section, of an alternative embodiment of the submergible umbrella stand of FIG. 1.

In certain embodiments, as seen in FIG. 12, umbrella sleeve 34 and the remainder of body 12 may be formed of one-piece construction. In such an embodiment, the upper end of upper portion 36 of umbrella sleeve 34 may be directly connected to first sleeve aperture 58. In such an embodiment, a collar 96 may be provided at the top of upper portion 36. Collar 96 may include a collar aperture 98 through which umbrella pole 32 extends. A peripheral flange 100 may extend outwardly from the peripheral edge of collar 96, and may be seated upon bottom 54 of reservoir 50. In such an embodiment umbrella pole 32 is anchored at two points along its length, namely at collar 96 and at is lowermost end where it engages the inner surface of upper portion 36 or the inner surface of lower portion 38, each of which is tapered as described above. As illustrated here, where umbrella pole 32 has a two inch diameter, the lowermost end of umbrella pole engages the inner surface of lower portion 38.

Various embodiments of a submergible umbrella stand have been described herein, which include various components and features. In other embodiments, the submergible umbrella stand may be provided with any combination of such components and features. It is also understood that in other embodiments, the various devices, components, and features of the submergible umbrella stand described herein may be constructed with similar structural and functional elements having different configurations, including different ornamental appearances.

Those having skill in the art, with the knowledge gained from the present disclosure, will recognize that various changes can be made to the disclosed apparatuses and methods in attaining these and other advantages, without departing from the scope of the present disclosure. As such, it should be understood that the features described herein are susceptible to modification, alteration, changes, or substitution. For example, it is expressly intended that all combinations of those elements and/or steps which perform substantially the same function, in substantially the same way, to achieve the same results are within the scope of the embodiments described herein. Substitutions of elements from one described embodiment to another are also fully intended and contemplated. The specific embodiments illustrated and described herein are for illustrative purposes only, and not limiting of that which is set forth in the appended claims. Other embodiments will be evident to those of skill in the art. It should be understood that the foregoing description is provided for clarity only and is merely exemplary. The spirit and scope of the present disclosure is not limited to the above examples, but is encompassed by the following claims.

What is claimed is:

1. A submergible umbrella stand comprising:

a body including a top, a bottom spaced from the top, and a body wall extending between the top and the bottom and defining a body cavity therein;

a lower recess formed in the bottom of the body and including a lower recess sidewall extending inwardly and upwardly from the bottom of the body into the body cavity and a top extending inwardly from a top of the lower recess sidewall;

at least one filling aperture formed in the top;

an umbrella sleeve positioned within the body and configured to receive an umbrella pole;

an upper recess formed in the top and including an upper recess sidewall extending inwardly and downwardly from the top of the body into the body cavity and a bottom extending inwardly from a bottom of the upper recess sidewall; and a first sleeve aperture formed in the bottom of the upper recess, the umbrella sleeve extending through the first sleeve aperture.

2. The submergible umbrella stand of claim 1, further comprising a second sleeve aperture formed in the top of the lower recess, the umbrella sleeve extending through the second sleeve aperture.

3. The submergible umbrella stand of claim 1, wherein the body wall tapers inwardly from a top edge thereof to a central portion thereof and tapers outwardly from the central portion to a bottom edge thereof.

4. The submergible umbrella stand of claim 1, wherein the body is formed of low density polyethylene.

5. The submergible umbrella stand of claim 1, further comprising a cover positioned on top of the body and including a central aperture formed therein, the central aperture configured to receive an umbrella pole.

6. The submergible umbrella stand of claim 5, wherein the cover is formed of high density polyethylene.

7. The submergible umbrella stand of claim 5, further comprising a central recess formed in the cover and including a sidewall and a bottom, the central aperture being formed in the bottom of the central recess.

8. The submergible umbrella stand of claim 7, further comprising a first insert receivable in the central recess and having a first insert aperture formed therein.

9. The submergible umbrella stand of claim 7, further comprising a second insert receivable in the central recess and having a second insert aperture formed therein.

10. The submergible umbrella stand of claim 1, wherein two filling apertures are formed in the top of the body.

11. The submergible umbrella stand of claim 1, further comprising at least one drain aperture formed in the bottom of the body.

12. The submergible umbrella stand of claim 1, wherein a bottom diameter of the body is larger than a top diameter of the body.

13. The submergible umbrella stand of claim 1, wherein the body is hourglass shaped.

14. The submergible umbrella stand of claim 1, wherein the umbrella sleeve includes an upper portion and a lower portion.

15. The submergible umbrella stand of claim 14, wherein the upper portion is tapered with a first diameter at an upper end thereof and a second diameter at a lower end thereof, the first diameter being larger than the second diameter.

16. The submergible umbrella stand of claim 14, wherein the lower portion is tapered with a first diameter at an upper end thereof and a second diameter at a lower end thereof, the first diameter being larger than the second diameter.

17. The submergible umbrella stand of claim 14, further comprising a collar positioned at an upper end of the upper portion.

18. The submergible umbrella stand of claim 17, wherein the collar includes a collar aperture configured to receive an umbrella pole.

19. A submergible umbrella stand comprising:

a body including a top, a bottom spaced from the top, and a body wall extending between the top and the bottom and defining a body cavity therein;

a pair of filling apertures formed in the top;

a pair of drain apertures formed in the bottom;

an upper recess formed in the top of the body and including an upper recess sidewall extending inwardly and downwardly from the top of the body into the body cavity and a bottom extending inwardly from a bottom of the upper recess sidewall, a first sleeve aperture being formed in the bottom of the upper recess;

a lower recess formed in the bottom of the body and including a lower recess sidewall extending inwardly and upwardly from the bottom of the body into the body cavity and a top extending inwardly from a top of the lower recess sidewall, a second sleeve aperture being formed in the top of the lower recess; and an umbrella sleeve extending vertically within the body through the first sleeve aperture and the second sleeve aperture.

* * * * *